US007625171B2

(12) United States Patent
Maguire et al.

(10) Patent No.: US 7,625,171 B2
(45) Date of Patent: Dec. 1, 2009

(54) COOLING SYSTEM FOR A GAS TURBINE ENGINE

(75) Inventors: Alan R Maguire, Derby (GB); John Hoptroff, Derby (GB)

(73) Assignee: Rolls-Royce plc, London (GB)

( * ) Notice: Subject to any disclaimer, the term of this patent is extended or adjusted under 35 U.S.C. 154(b) by 573 days.

(21) Appl. No.: 11/385,645

(22) Filed: Mar. 22, 2006

(65) Prior Publication Data

US 2006/0222486 A1 Oct. 5, 2006

(30) Foreign Application Priority Data

Apr. 1, 2005 (GB) ..... 0506623.8

(51) Int. Cl.
*F01D 5/08* (2006.01)

(52) U.S. Cl. ..... 415/115; 415/116

(58) Field of Classification Search ..... None
See application file for complete search history.

(56) References Cited

U.S. PATENT DOCUMENTS 3,989,410 A * 11/1976 Ferrari ..... 415/115
4,425,079 A * 1/1984 Speak et al. ..... 415/115
4,466,239 A * 8/1984 Napoli et al. ..... 415/116
4,657,482 A 4/1987 Neal
5,402,636 A * 4/1995 Mize et al. ..... 415/115
5,800,125 A * 9/1998 Largillier et al. ..... 416/96 R
5,816,776 A * 10/1998 Chambon et al. ..... 416/95
5,984,630 A * 11/1999 Di Salle et al. ..... 415/174.5
6,095,750 A * 8/2000 Ross et al. ..... 415/115
6,787,947 B2 * 9/2004 Coulon et al. ..... 415/115
7,048,497 B2 * 5/2006 Arilla et al. ..... 415/116
2003/0223856 A1 * 12/2003 Yuri et al. ..... 415/115
2004/0247429 A1 12/2004 Arilla

FOREIGN PATENT DOCUMENTS

GB 1 268 301 SP 3/1972
GB 1 525 746 SP 9/1978

* cited by examiner

*Primary Examiner*—Richard Edgar
(74) *Attorney, Agent, or Firm*—Jeffrey S. Melcher; Manelli Denison & Selter PLLC

(57) ABSTRACT

A cooling system for a gas turbine engine (FIG. 1) comprises a pre-swirl arrangement, preferably including a pre-swirl chamber, for providing cooling air to a turbine blade disc, and a ventilation arrangement for providing ventilation air to a rotating component of the gas turbine engine. The cooling system includes an air bypass arrangement, which preferably includes first, second and third air bypass duct portions, for conveying ventilation air away from the pre-swirl arrangement.

21 Claims, 2 Drawing Sheets

COOLING SYSTEM FOR A GAS TURBINE ENGINE

FIELD OF THE INVENTION

The present invention relates to a cooling system for a gas turbine engine.

BACKGROUND OF THE INVENTION

Cooling systems for cooling turbine blades in gas turbine engines often employ a pre-swirl arrangement to reduce the temperature of the cooling air and to accelerate the cooling air before it is fed to the turbine blade mounting disc for blade cooling. Acceleration of the cooling to a speed approaching or equal to the rotational speed of the rim of the blade mounting disc minimises aerodynamic losses as the cooling air is transferred from the static structure of the gas turbine engine to the rotating engine components.

Acceleration of the cooling air creates a pressure loss in the pre-swirl arrangement and, consequently, other air flows within the gas turbine engine may contaminate the cooling air flow provided by the pre-swirl arrangement.

SUMMARY OF THE INVENTION

According to a first aspect of the present invention, there is provided a cooling system for a gas turbine engine, the cooling system comprising a pre-swirl arrangement for providing cooling air to a turbine blade disc, and a ventilation arrangement for providing ventilation air to a rotating component of the gas turbine engine, characterised in that the cooling system includes an air bypass arrangement for conveying ventilation air away from the pre-swirl arrangement.

The pre-swirl arrangement may comprise a pre-swirl chamber.

The air bypass arrangement may be arranged to convey ventilation air to a further rotating component of the gas turbine engine preferably to provide cooling to the further rotating component.

The air bypass arrangement may include an air bypass duct which may be arranged to convey ventilation air to a further rotating component of the gas turbine engine preferably to provide cooling to the further rotating component.

The air bypass duct may include a first air bypass duct portion which may extend circumferentially about a rotational axis of the gas turbine engine. The first air bypass duct portion may be generally annular.

The first air bypass duct portion may define an air inlet which may be arranged to receive, in use, ventilation air from the ventilation arrangement. The air inlet may also be arranged to receive, in use, a proportion of cooling air from the pre-swirl arrangement.

The air bypass arrangement may include a second air bypass duct portion which may intersect the pre-swirl arrangement. The second air bypass duct portion may intersect an air supply arrangement of the pre-swirl arrangement. The second air bypass duct portion may extend generally radially through the air supply arrangement.

The air bypass arrangement may include a third air bypass duct portion which may be defined in part by a static component of the gas turbine engine structure. The third air bypass duct portion may be defined in part by a combustion rear inner casing of the gas turbine engine. The third air bypass duct portion may be further defined in part by a movable sealing component of the gas turbine engine.

The third air bypass duct portion may be further defined in part by an expandible sealing member which may be provided between the movable sealing component and the pre-swirl arrangement. The expandible sealing member may be operable in use to prevent the passage of cooling air from the pre-swirl arrangement into the third air bypass duct portion. The expandible sealing member may comprise a spiral sealing ring arrangement.

The second air bypass duct portion may be arranged to receive air from the first air bypass duct portion and to convey the air into the third air bypass duct portion.

The movable sealing component may include a pre-swirl means and the third air bypass duct portion may be arranged to convey the air from the third air bypass duct portion through the pre-swirl means.

The pre-swirl means may be arranged to convey air from the third air bypass duct portion towards a rotating seal component of the gas turbine engine to cool the rotating seal component. Alternatively or additionally, the pre-swirl means may be arranged to convey air from the third air bypass duct portion towards a rim of the turbine blade mounting disc to cool the disc rim. Alternatively or additionally, the pre-swirl means may be arranged to convey air from the third air bypass duct portion into a cooling passage of a turbine blade to cool the blade.

The pressure at a downstream end of the air bypass arrangement may be lower than the pressure in the pre-swirl arrangement, and a small proportion of cooling air may be conveyed from the pre-swirl arrangement into the air bypass arrangement. The air exiting the air bypass arrangement, preferably through the pre-swirl means, may accordingly comprise both ventilation air from the ventilation arrangement and cooling air from the pre-swirl arrangement.

According to a second aspect of the present invention, there is provided a gas turbine engine including a cooling system according to any of the preceding definitions.

BRIEF DESCRIPTION OF THE DRAWINGS

An embodiment of the present invention will now be described by way of example only, and with reference to the accompany drawings, in which:—

DETAILED DESCRIPTION OF THE INVENTION

Figure 1:
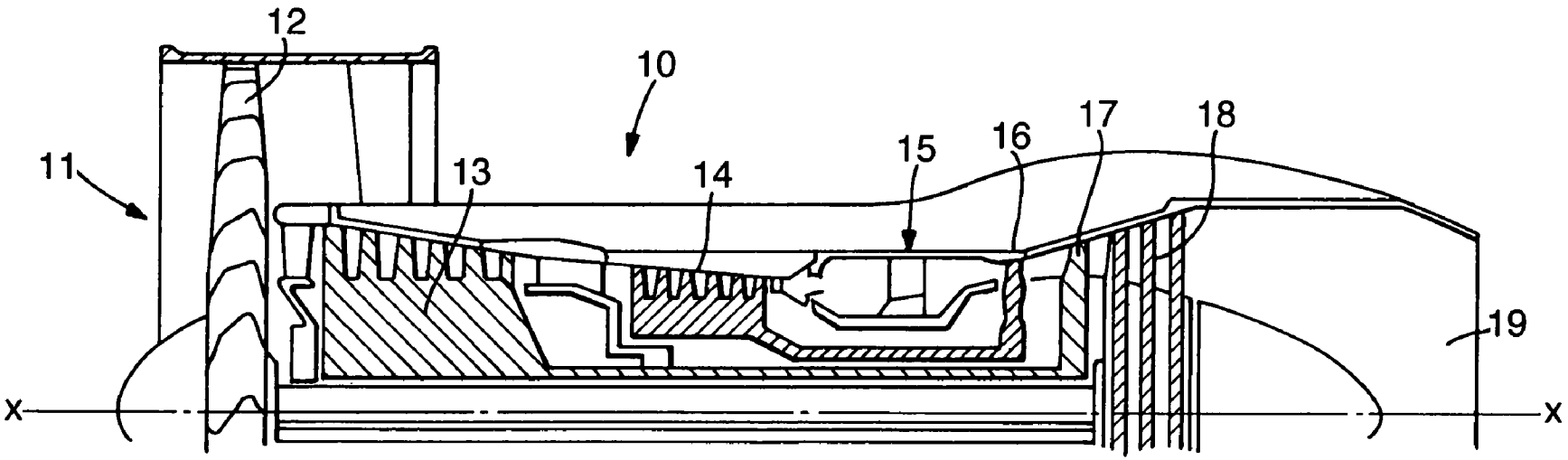
FIG. 1 is a diagrammatic cross-sectional view of part of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produces two air flows: a first air flow into the intermediate pressure compressor 13 and a second air flow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13, and the fan 12 by suitable interconnecting shafts.

Figure 2:
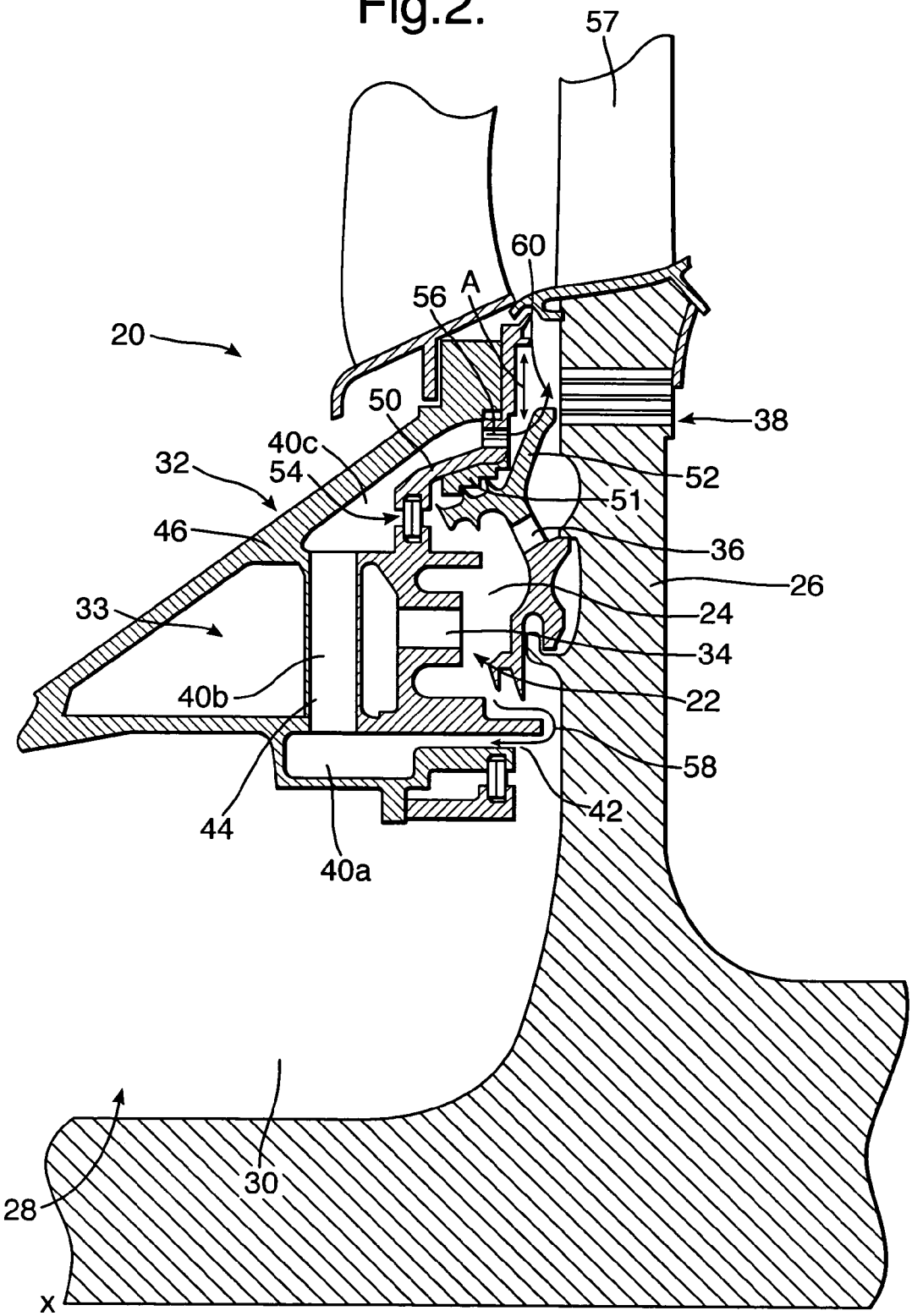
FIG. 2 is a diagrammatic cross-sectional of a cooling system according to the present invention.

FIG. 2 illustrates a cooling system, generally designated by the reference numeral 20, for use in a gas turbine engine such as the gas turbine engine 10 described above. The cooling system 20 generally comprises a pre-swirl arrangement 22 for providing cooling air to a blade mounting disc 26 of the gas turbine engine 10. The cooling system 20 further includes a ventilation arrangement 28, for example comprising a ventilation chamber 30 (only part of which is shown in FIG. 2), for providing ventilation air to a rotating component of the gas turbine engine 10, such as a drive arm of the high pressure compressor 14.

The pre-swirl arrangement 22 includes an air supply arrangement 33 which conveys air through a pre-swirl passage 34 into a pre-swirl chamber 24. The air is accelerated through the pre-swirl passage 34 to a speed approaching or equal to the rotational speed of the rim 38 of the blade mounting disc 26. As is well known in the art, the pre-swirl passage 34 imparts a swirl to the air as it flows into the pre-swirl chamber 24.

The cooling air from the pre-swirl chamber 24 is then fed into an air supply passage 36 which directs cooling air from the pre-swirl chamber 24 towards the rim 38 of the blade mounting disc 26. The cooling system 20 includes a plurality of pre-swirl passages 34 and air supply passages 36 spaced circumferentially about the longitudinal rotational axis X-X of the gas turbine engine 10.

In order to prevent air from the ventilation chamber 30 entering into the pre-swirl chamber 24, the cooling system 20 includes an air bypass arrangement, generally designated by the reference numeral 32, for conveying ventilation air away from the pre-swirl arrangement 22, and in particular away from the pre-swirl chamber 24. The air bypass arrangement 32 includes first, second and third air bypass duct portions 40*a-c* which communicate with each other and which are arranged to convey ventilation air from the ventilation chamber 30 away from the pre-swirl chamber 24 to a further rotating component or further rotating components of the gas turbine engine to cool that component or those components.

In more detail, the first air bypass duct portion 40*a* extends circumferentially about the longitudinal rotational axis X-X of the engine 10 to define a generally annular passage. The first air bypass duct portion 40*a* defines an air inlet 42 for receiving air from the ventilation chamber 30, and is arranged to convey the ventilation air away from the pre-swirl chamber 24. A small proportion of cooling air from the pre-swirl chamber 24 may be conveyed into the first air bypass duct portion 40*a* and through the air bypass arrangement 32, as will be explained in more detail hereinafter. According to one embodiment of the invention, the first air bypass duct portion 40*a* is defined by structural components of the engine 10, such as engine casing components and the like.

The second air bypass duct portion 40*b* comprises a plurality of air transfer tubes 44 which are arranged circumferentially about the longitudinal rotational axis X-X of the engine 10. The air transfer tubes 44 intersect the air supply arrangement 33, extending generally radially through the air supply arrangement 33. The air transfer tubes 44 thus convey air from the first air bypass duct portion 40*a* into the third air bypass duct portion 40*c* without mixing with the air flowing through the air supply arrangement 33.

Due to space constraints within the gas turbine engine 10, the third air bypass duct portion 40*c* is defined as far as possible by existing structural components of the engine 10. According to one embodiment, the third air bypass duct portion 40*c* is defined in part by a static component of the engine structure, namely the combustion rear inner casing 46, and by a movable sealing component 50 of the engine 10. The movable sealing component 50 includes a sealing member 51 which is co-operable, in use, with a cover plate 52 to seal the upper end of the pre-swirl chamber 24 and prevent leakage of cooling air therefrom.

The movable sealing component 50 may move inwardly or outwardly in the radial direction of the engine 10, as indicated by the arrow A, so that sealing contact is maintained at all times between the sealing member 51 and the cover plate 52.

In order to prevent air leakage from the third air bypass duct portion 40*c* into the pre-swirl chamber 24, an expandible sealing member 54 is provided between the movable sealing component 50 and the pre-swirl arrangement 22. The expandible sealing member 54 is capable of maintaining a seal irrespective of the radial position of the movable sealing component 50, and according to one embodiment of the invention comprises a spiral sealing ring arrangement. It will of course be appreciated that any suitable sealing member may be used.

The third air bypass duct portion 40*c* is arranged to convey air into a pre-swirl means 56, for example in the form of a passage similar to the pre-swirl passage 34, defined in the movable sealing component 50. The pre-swirl means 56 is arranged to convey air from the third air bypass duct portion 40*c* towards a rotating component of the engine 10 to cool the rotating component, as will now be described in detail.

During operation of the cooling system 20 according to the invention, ventilation air from the ventilation chamber 30 is conveyed by the air bypass arrangement 32 away from the pre-swirl chamber 24 along the first, second and third air bypass duct portions 40*a-c*. It is desirable to convey the ventilation air away from the pre-swirl chamber 24 to prevent its entry into the pre-swirl chamber 24 since the ventilation air will be hotter than the cooling air in the pre-swirl chamber 24 and will have a only a relatively small whirl component. The present invention therefore avoids contamination of the cooling air in the pre-swirl chamber 24 with ventilation air. In prior art arrangements, there is a tendency for the ventilation air to be sucked into the pre-swirl chamber 24 since the pressure in the pre-swirl chamber 24 is normally lower than the pressure in the ventilation chamber 30.

In order to convey the ventilation air away from the pre-swirl chamber 24 via the air bypass arrangement 32, a low pressure is established at the downstream end of the air bypass arrangement 32, that is at the outlet from the pre-swirl means 56, by opening up the downstream end of the by bypass arrangement 32 to create a lower pressure than the pressure in the ventilation chamber 30. According to one embodiment, this lower pressure may be achieved by establishing fluid communication between the pre-swirl means 56 and a rotating component of the gas turbine engine 10, for example a low pressure feed for a trailing edge of the high pressure turbine blade 57.

Due to the positive pressure which results from the pressure difference between the upstream and the downstream ends of the air bypass arrangement 32, ventilation air from the ventilation chamber 30 is conveyed through the air inlet 42 into the first air bypass duct portion 40*a*. In order to ensure that the ventilation air does not enter into the pre-swirl chamber 24, the pressure at the downstream end of the air bypass arrangement 32 is lower than the pressure in the pre-swirl chamber 24. Accordingly, a small proportion of cooling air may be conveyed from the pre-swirl chamber 24, as illustrated by arrow 58, through the air inlet 42 into the air bypass arrangement 32. The air exiting the air bypass arrangement 32 through the pre-swirl means 50 may accordingly comprise both ventilation air from the ventilation chamber 30 and cooling air from the pre-swirl chamber 24, although, as highlighted, only a small proportion of the latter may be present.

When the air has been conveyed along the first, second and third air bypass duct portions 40*a-c*, it is directed by the pre-swirl means 56 towards the rotating cover plate 52 to cool the cover plate 52. This is illustrated diagrammatically by arrow 60. The pre-swirl means 56 may alternatively or additionally direct the air towards the rim 38 of the blade mounting disc 26 to cool the disc rim 38 and/or into a cooling passage (not shown) in the turbine blade 57 to cool the blade 57.

There is thus provided a cooling system 20 for a gas turbine engine 10 which, by conveying ventilation air away from the pre-swirl chamber 24, prevents the ventilation air from entering the pre-swirl chamber 24 and thereby contaminating the main blade cooling air in the pre-swirl chamber 24.

The provision of an air cooling system 20 which incorporates an air bypass arrangement 32 as described is also advantageous since the air conveyed by the air bypass arrangement 32 is used to provide cooling to further components of the gas turbine engine 10.

Furthermore, by utilising existing engine structural components to define the air bypass arrangement 32, the compactness of the air bypass arrangement 32, and hence the resulting cooling system 20, can be maximised.

Although embodiments of the invention have been described in the preceding paragraphs with reference to various examples, it should be appreciated that various modifications to the examples given may be made without departing from the scope of the present invention, as claimed. For example, the first, second and third air bypass duct portions 40*a-c* may be of any suitable configuration or arrangement. Any suitable expandible sealing member 54 may be employed. Suitable pre-swirl vanes may be used instead of the pre-swirl passage 34. The pre-swirl means 56 may also be defined by suitable vanes instead of a pre-swirl passage.

Whilst endeavouring in the foregoing specification to draw attention to those features of the invention believed to be of particular importance, it should be understood that the Applicant claims protection in respect of any patentable feature or combination of features hereinbefore referred to and/or shown in the drawings, whether or not particular emphasis has been placed thereon.

We claim:

1. A cooling system for a gas turbine engine, the cooling system comprising a pre-swirl chamber, a pre-swirl arrangement for providing cooling air to a turbine blade disc, and a ventilation arrangement for providing ventilation air to a rotating component of the gas turbine engine, said cooling system including an air bypass arrangement for conveying ventilation air away from the pre-swirl arrangement, wherein the ventilation air is at a lower pressure than the cooling air and a portion of cooling air is conveyed into said air bypass arrangement from said pre-swirl chamber, said air bypass arrangement including a first air bypass duct portion, a second air bypass duct portion and a third air bypass duct portion wherein said third air bypass duct portion is defined in part by a static component of the gas turbine engine structure and wherein the third air bypass duct portion is further defined in part by a movable sealing component of the gas turbine engine.

2. A cooling system according to claim 1, wherein the air bypass arrangement is arranged to convey ventilation air to a further rotating component of the gas turbine engine to provide cooling to the further rotating component.

3. A cooling system according to claim 1, wherein the air bypass arrangement includes an air bypass duct for conveying ventilation air to a further rotating component of the gas turbine engine to provide cooling to the further rotating component.

4. A cooling system according to claim 3, wherein said first air bypass duct portion extends circumferentially about a rotational axis of the gas turbine engine.

5. A cooling system according to claim 4, wherein the first air bypass duct portion is generally annular.

6. A cooling system according to claim 4, wherein the first air bypass duct portion defines an air inlet for receiving, in use, ventilation air from the ventilation arrangement.

7. A cooling system according to claim 6, wherein the air inlet is also arranged to receive, in use, a proportion of cooling air from the pre-swirl arrangement.

8. A cooling system according to claim 4, wherein said second air bypass duct portion intersects the pre-swirl arrangement.

9. A cooling system according to claim 8, wherein the second air bypass duct portion is arranged to receive air from the first air bypass duct portion and to convey the air into the third air bypass duct portion.

10. A cooling system according to claim 1, wherein said second air bypass duct portion intersects the pre-swirl arrangement.

11. A cooling system according to claim 10, wherein the second air bypass duct portion intersects an air supply arrangement of the pre-swirl arrangement.

12. A cooling system according to claim 11, wherein the second air bypass duct portion extends generally radially through the air supply arrangement.

13. A cooling system according to claim 1, wherein the third air bypass duct portion is defined in part by a combustion rear inner casing of the gas turbine engine.

14. A cooling system according to claim 1, wherein the movable sealing component includes a pre-swirl means and the third air bypass duct portion is arranged to convey the air from the third air bypass duct portion through the pre-swirl means.

15. A cooling system according to claim 14, wherein the pre-swirl means is arranged to convey air from the third air bypass duct portion towards a rotating seal component of the gas turbine engine to cool the rotating seal component.

16. A cooling system according to claim 14, wherein the pre-swirl means is arranged to convey air from the third air bypass duct portion towards a rim of the turbine blade mounting disc to cool the disc rim.

17. A cooling system according to claim 14, wherein the pre-swirl means is arranged to convey air from the third air bypass duct portion into a cooling passage of a turbine blade to cool the blade.

18. A gas turbine engine including a cooling system according to claim 1.

19. A cooling system for a gas turbine engine, the cooling system comprising a pre-swirl arrangement for providing cooling air to a turbine blade disc, and a ventilation arrangement for providing ventilation air to a rotating component of the gas turbine engine, said cooling system includes an air bypass arrangement for conveying ventilation air away from the pre-swirl arrangement wherein the air bypass arrangement includes a first air bypass duct portion, a second air bypass duct portion and a third air bypass duct portion wherein said third air bypass duct portion is defined in part by a static component of the gas turbine engine structure wherein said third air bypass duct portion is further defined in part by a movable sealing component of the gas turbine engine and wherein the third air bypass duct portion is further defined in part by an expandable sealing member provided between the movable sealing component and the pre-swirl arrangement.

20. A cooling system according to claim 19, wherein the expandable sealing member is operable in use to prevent the passage of cooling air from the pre-swirl arrangement into the third air bypass duct portion.

21. A cooling system according to claim 19, wherein the expandable sealing member comprises a spiral sealing ring arrangement.

* * * * *

UNITED STATES PATENT AND TRADEMARK OFFICE

CERTIFICATE OF CORRECTION

PATENT NO. : 7,625,171 B2
APPLICATION NO. : 11/385645
DATED : December 1, 2009
INVENTOR(S) : Maguire et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 827 days.

Signed and Sealed this

Twenty-sixth Day of October, 2010

David J. Kappos

David J. Kappos
*Director of the United States Patent and Trademark Office*